US005394856A

United States Patent [19]

Furuya

[11] Patent Number: 5,394,856

[45] Date of Patent: Mar. 7, 1995

[54] SYSTEM FOR AND METHOD OF CONTROLLING AIR-FUEL RATIO IN INTERNAL COMBUSTION ENGINE

[75] Inventor: Junichi Furuya, Atsugi, Japan

[73] Assignee: Unisia Jecs Corporation, Atsugi, Japan

[21] Appl. No.: 106,757

[22] Filed: Aug. 16, 1993

[30] Foreign Application Priority Data

Aug. 17, 1992 [JP] Japan ..... 4-218000

[51] Int. Cl.[6] ..... F02D 41/14

[52] U.S. Cl. ..... 123/681

[58] Field of Search ..... 123/679, 681, 696

[56] References Cited

U.S. PATENT DOCUMENTS

| | | | |
|---|---|---|---|
| 4,528,962 | 7/1985 | Auth | 123/696 |
| 4,913,121 | 4/1990 | Shimomura et al. | 123/681 |
| 5,050,560 | 9/1991 | Plapp | 123/681 |
| 5,253,631 | 10/1993 | Curran | 123/696 |
| 5,311,853 | 5/1994 | Takahashi et al. | 123/681 |

FOREIGN PATENT DOCUMENTS

| | | | |
|---|---|---|---|
| 0183539 | 11/1982 | Japan | 123/681 |
| 0035246 | 3/1983 | Japan | 123/681 |
| 60-240840 | 11/1985 | Japan . | |

*Primary Examiner*—Andrew M. Dolinar
*Assistant Examiner*—Thomas N. Moulis
*Attorney, Agent, or Firm*—Foley & Lardner

[57] ABSTRACT

In an air-fuel ratio control system for an internal combustion engine, a proportional part for determining a feedback correction factor is corrected by a value proportional to an intake air flow corresponding value, whereas an integral part for determining the feedback correction factor is corrected by a value proportional to a square of the intake air flow corresponding value.

4 Claims, 4 Drawing Sheets

SYSTEM FOR AND METHOD OF CONTROLLING AIR-FUEL RATIO IN INTERNAL COMBUSTION ENGINE

BACKGROUND OF THE INVENTION

The present invention relates generally to an air-fuel ratio control system for an internal combustion engine and more particularly, to an air-fuel ratio control system which fulfills feedback control of an air-fuel ratio.

One of conventional air-fuel ratio control system for an internal combustion engine is disclosed, for example, in JP-A 60-240840.

With this conventional air-fuel ratio control system, an intake air flow Q and a rotating speed N of the engine are detected to calculate a basic fuel supply amount $T_P$ ($=K \cdot Q/N$ wherein K is a constant) corresponding to an amount of air inhaled in cylinders. This basic fuel supply amount $T_P$ is corrected by an engine temperature, etc., which is subjected to feedback correction in response to a signal derived from an air-fuel ratio sensor or oxygen sensor for sensing the air-fuel ratio of air-fuel mixture based on detection of an oxygen concentration in exhaust, and also correction by a battery voltage, etc., determining finally a fuel supply amount $T_I$.

A drive pulse signal having a pulse width corresponding to the fuel supply amount $T_I$ thus determined is output at a predetermined timing, injecting and supplying a predetermined amount of fuel to the engine.

Air-fuel ratio feedback correction in response to a signal derived from the air-fuel ratio sensor is carried out to control the air-fuel ratio in the vicinity of a target air-fuel ratio or theoretical air-fuel ratio. Because a conversion efficiency or purification efficiency of a catalytic converter rhodium disposed in an exhaust system for oxygenating carbon monoxide (CO) and hydrocarbon (HC) in exhaust and reducing nitrogen oxides ($N0_X$) therein for purification is determined to effectively function in an exhaust state upon theoretical air-fuel ratio combustion.

A proportional part and an integral part are determined in accordance with, for example, a deviation between the air-fuel ratio sensed by the air-fuel ratio sensor and the target air-fuel ratio, respectively. A value obtained by adding the proportional part and the integral part is multiplied, as a feedback correction factor ALPHA, by the basic fuel supply amount $T_P$, controlling the air-fuel ratio in the vicinity of the theoretical air-fuel ratio.

With the prior art which fulfills such feedback control of the air-fuel ratio, the optimum values of the proportional part P and the integral part I vary according to engine operating conditions such as rotating speed, load, etc. Thus, some air-fuel ratio control systems allocate these parts in accordance with the engine operating conditions. In this case, without subdividing an operating area to be allocated, or adding an interpolating operation, a difference is produced between each required value and a set value, resulting in deteriorated accuracy. However, the above addition causes a problem that a microcomputer for carrying out control computing undergoes a heavy burden.

For varying the parts according to the engine operating conditions, the following methods are applicable: increasing an update amount per time as the rotating speed is higher by updating the integral part in synchronism with the rotating speed; determining, as the integral value, a value obtained by multiplying an integrated value of an update amount of a certain integration constant by a load such as fuel injection amount $T_P$ or $T_I$ so as to be increased as the load is greater; determining the integral part substantially as the inlet air flow Q is greater by combining the above two methods with each other. However, such methods are not always effective in determining the optimum value of the integral value, and thus further improvement of the control accuracy can be expected.

It is, therefore, an object of the present invention to provide a system for and method of controlling an air-fuel ratio in an internal combustion engine which allows feedback control of the air-fuel ratio with higher accuracy.

SUMMARY OF THE INVENTION

According to one aspect of the present invention, there is provided a system for controlling an air-fuel ratio of air-fuel mixture to be supplied to an internal combustion engine, the system comprising:

an air-fuel ratio sensor means for providing an output value variable in response to a concentration ratio of a constituent in exhaust, said concentration ratio being variable according to the air-fuel ratio;

an air-fuel ratio feedback control means for comparing said output value of said air-fuel ratio sensor means with a reference value corresponding to a target air-fuel ratio and controlling the air-fuel ratio to be close to said target air-fuel ratio by using a feedback correction factor;

a proportional part setting means for setting a proportional part for determining said feedback correction factor, said proportional part being corrected by a value proportional to an intake air flow corresponding value; and an integral part setting means for setting an integral part for determining said feedback correction factor, said integral part being corrected by a value proportional to a square of said intake air flow corresponding value.

According to another aspect of the present invention, there is provided a method of controlling an air-fuel ratio of air-fuel mixture to be supplied to an internal combustion engine, the method comprising the steps of:

providing an output value variable in response to a concentration ratio of a constituent in exhaust, said concentration ratio being variable according to the air-fuel ratio;

comparing said output value of said air-fuel ratio sensor means with a reference value corresponding to a target air-fuel ratio and controlling the air-fuel ratio to be close to said target air-fuel ratio by using a feedback correction factor;

setting a proportional part for determining said feedback correction factor, said proportional part being corrected by a value proportional to an intake air flow corresponding value; and setting an integral part for determining said feedback correction factor, said integral part being corrected by a value proportional to a square of said intake air flow corresponding value.

DETAILED DESCRIPTION OF THE INVENTION

Figure 1:
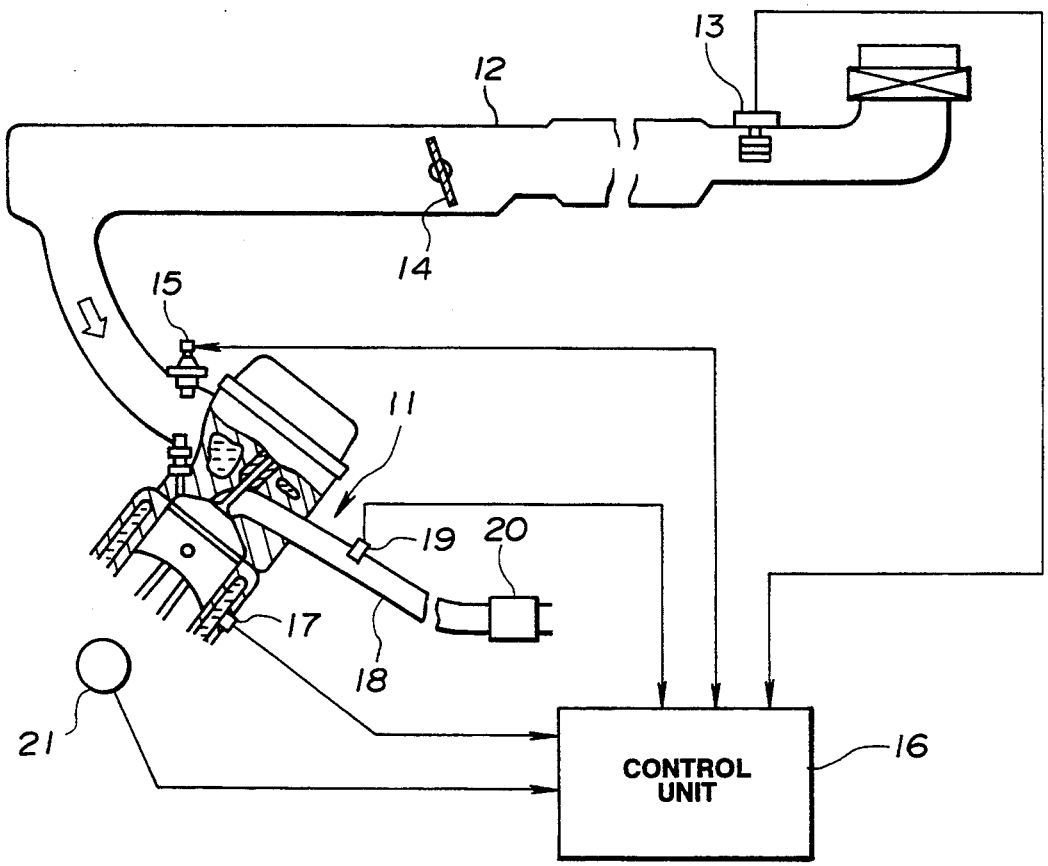
FIG. 1 is a diagrammatic view showing a constitution of a preferred embodiment of the present invention.

Referring to the drawings, a preferred embodiment of the present invention will be described.

Referring first to FIG. 1, arranged within an intake passage 12 of an engine 11 are an airflow meter 13 for detecting an intake air flow Q and a throttle valve 14 for controlling the intake air flow Q in connection with an accelerator pedal. An electromagnetic fuel injection valve 15 is arranged, as a fuel supply :means, to a manifold portion downstream of the intake passage 12 for each cylinder.

The fuel injection valve 15 is opened by aninjection-pulse signal derived from a control unit 16 comprising a microcomputer so as to inject and supply fuel force-fed from a fuel pump (not shown) and controlled at a predetermined pressure by a pressure regulator. Additionally, there are arranged a coolant temperature sensor 17 for sensing a temperature Tw of coolant within a cooling jacket of an engine 11, an air-fuel ratio sensor 19 for sensing an air-fuel ratio of intake air-fuel :mixture by sensing an oxygen concentration in exhaust in an exhaust passage 18, and a catalytic converter rhodium 20 for oxygenating CO and HC in exhaust on the downstream side and reducing $NO_X$ therein for purification.

Additionally, a distributor (not shown) comprises a crank angle sensor 21 which outputs a crank unit angle indicative signal in synchronism with engine rotation. An engine rotating speed N is detected by counting the crank unit angle indicative signal during a predetermined time, or measuring a period of a crank reference angle indicative signal.

Figure 2:
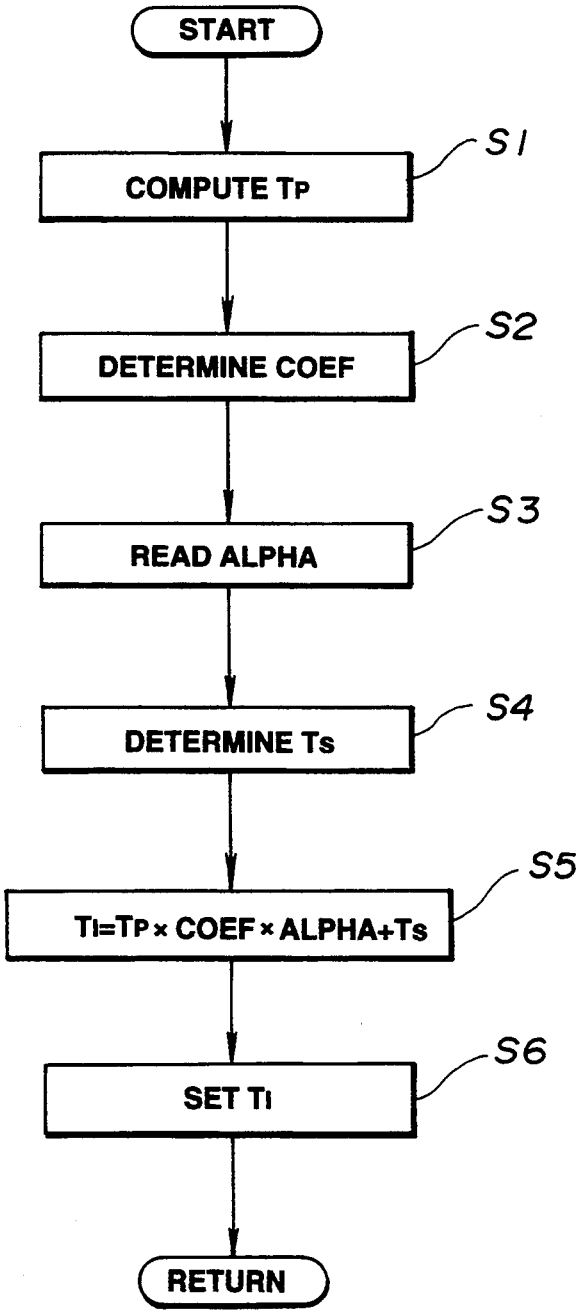
FIG. 2 is a flowchart showing a fuel injection amount setting routine of the preferred embodiment.
Figure 3:
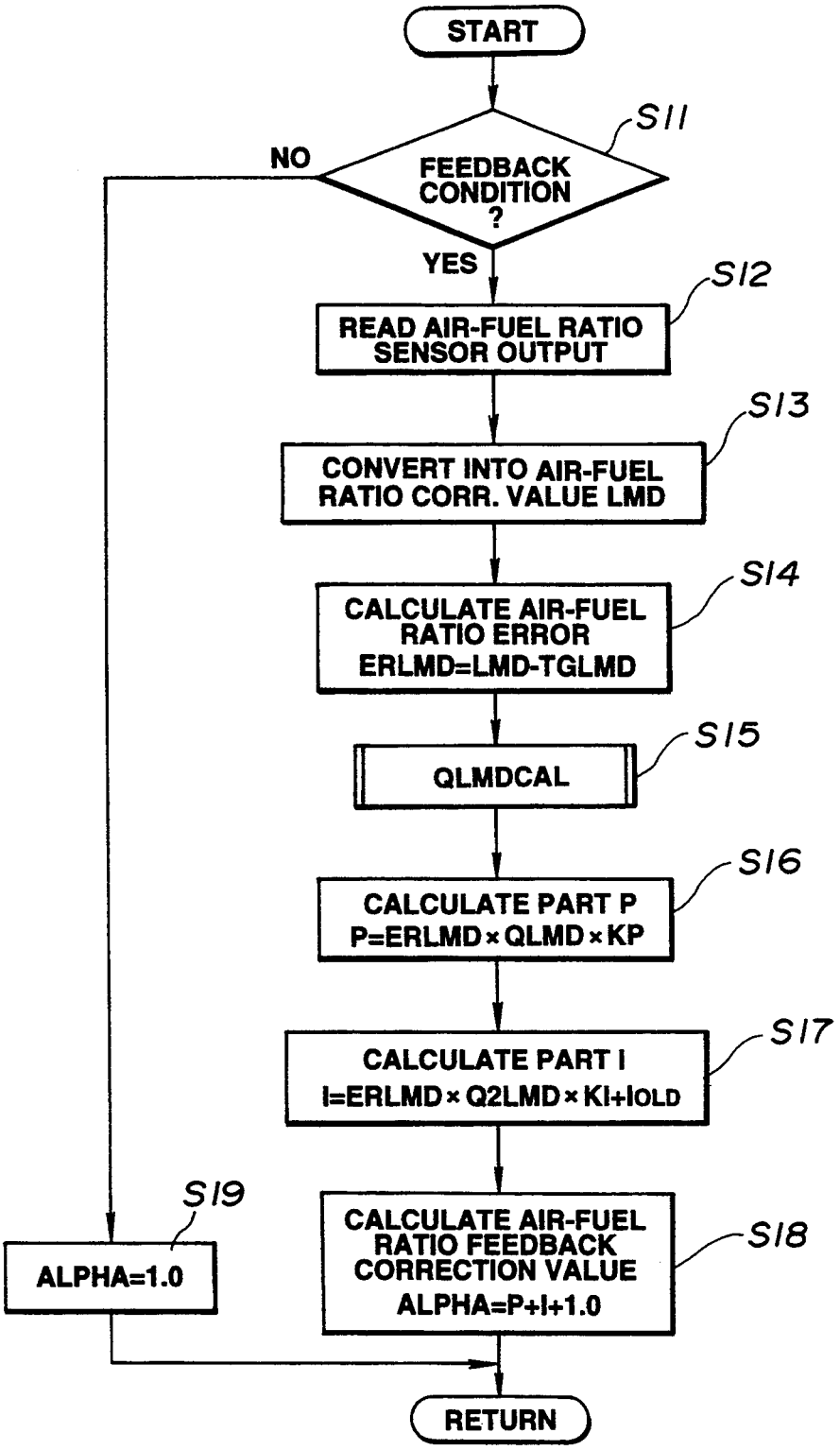
FIG. 3 is a view similar to FIG. 2, showing an air-fuel ratio correction factor setting routine of the preferred embodiment.

Next, referring to FIGS. 3 to 5, an air-fuel ratio control routine of the control unit will be described. It is to be noted that FIG. 2 shows a fuel injection amount setting routine which is executed every predetermined period, for example, 10 ms.

At a step S1, based on the intake air flow Q detected by the airflow meter 13 and the engine rotating speed N calculated in response to a signal derived from the crank angle sensor 21, a basic fuel injection amount $T_P$ corresponding to an intake air amount per unit rotation is computed according to the following formula:

$$T_P = K \times Q/N \text{ (K is a constant)}$$

At a step S2, various correction factors COEF are determined based on the coolant temperature Tw sensed by the coolant temperature sensor 17, etc.

At a step S3, a feedback correction factor ALPHA determined in response to a signal derived from the air-fuel ratio sensor 19 is read according to a feedback factor settling routine as will be described later.

At a step S4, a voltage correction part $T_S$ is determined based on a value of a battery voltage. This is for correcting variation in an injection flow of the fuel injection valve 15 due to fluctuation in the battery voltage.

At a step S5, a final fuel injection amount $T_I$ is computed according to the following formula:

$$T_I = T_P \times COEF \times ALPHA + T_S$$

At a step S6, the fuel injection amount $T_I$ as computed is set in an output register.

Thus, upon a predetermined fuel injection timing in synchronism with engine rotation, a drive pulse signal having a pulse width of the fuel injection amount $T_I$ as computed is provided to the fuel injection valve 15, carrying out fuel injection.

Next, referring to FIG. 3, the feedback correction factor setting routine according to the present invention will be described.

At a step S11, it is determined whether or not the engine 11 falls in operating conditions which require feedback control of the air-fuel ratio. If the engine 11 fails to meet feedback conditions, the routine is ended. In this case, the routine proceeds to a step S19 wherein the feedback correction factor ALPHA is clamped to a value upon completion of full open feedback control, or a predetermined reference value, for example, 1, ceasing feedback control.

At a step S12, a signal voltage $V_{02}$ is input from the air-fuel ratio sensor 19.

At a step S13, the signal voltage $V_{02}$ as input is converted into an air-fuel ratio corresponding value LMD.

At a step S14, an error amount ERLMD of the air-fuel ratio LMD as obtained at the step S13 with respect to a target air-fuel ratio TGLMD is calculated according to the following formula:

$$ERLMD = LMD - TGLMD$$

At a step S15, calculation is made with regard to an intake air flow corresponding value QLMD to be used in a roportional part P and an integral part I as will be described later, and a square value thereof.

Figure 4:
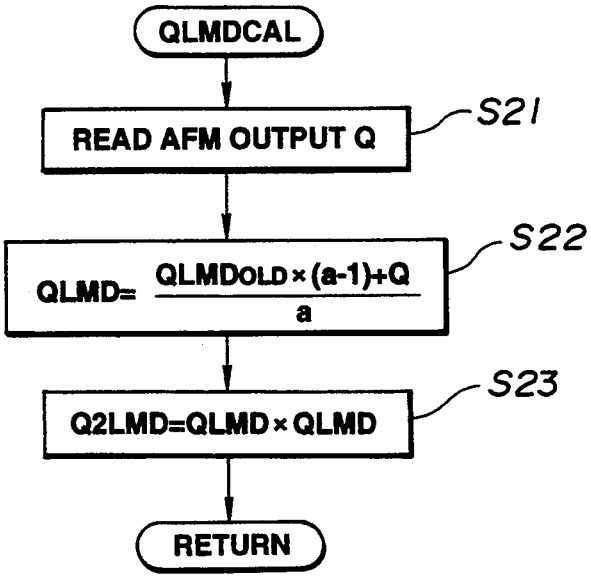
FIG. 4 is a view similar to FIG. 3, showing one subroutine for calculating an intake air flow corresponding value using an airflow meter, and a square value thereof.
Figure 5:
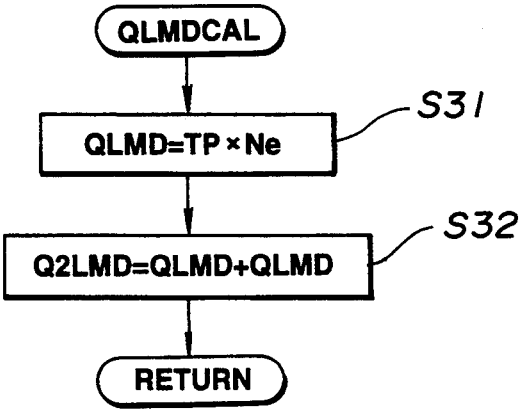
FIG. 5 is a view similar to FIG. 4, showing another subroutine for calculating the intake air flow corresponding value using a basic fuel injection amount $T_P$ and an engine rotating speed N, and a square value thereof.

Referring to FIGS. 4 and 5, two examples each showing a method of obtaining the intake air flow corresponding value QLMD and the square value will be described.

FIG. 4 shows one subroutine for obtaining the above two values using a detected value of the airflow meter 13. At a step S21, an output value Q of the airflow meter 13 is read, then at the step S22, a weighted average processing of the output value Q and the preceding value is carried out according to the following formula:

$$QLMD = \{QLMD_{OLD} \times (a-1) + Q\}/a$$

At a step S23, the square value of QLMD is obtained as Q2LMD.

FIG. 5 shows another subroutine for obtaining the above two values based on the basic fuel injection amount $T_P$ and the engine rotating speed N. At a step S31, the intake air flow corresponding value QLMD is calculated as a product of the basic fuel injection amount $T_P$ and the engine rotating speed N, then at a step S32, the square value of QLMD is obtained as Q2LMD.

Returning to FIG. 3, at a step S16, using QLMD obtained as described above, the proportional part P is calculated according to the following formula:

$$P=ERLMD\times QLMD\times KP$$

(KP is a constant)

At a step S17, using Q2LMD obtained as described above, the integral part I is calculated according to the following formula:

$$I=ERLMD\times Q2LMD\times KI\times I_{OLD}$$

(KP is a constant, and $I_{OLD}$ is the preceding value of I)

At a step S18, based on the proportional part P and the integral part I, the feedback correction factor ALPHA is calculated according to the following formula:

$$ALPHA=P+I+1.0$$

Next, a description will be made with regard to a reason why the proportional part P and the integral part I are obtained as described above.

Figure 6:
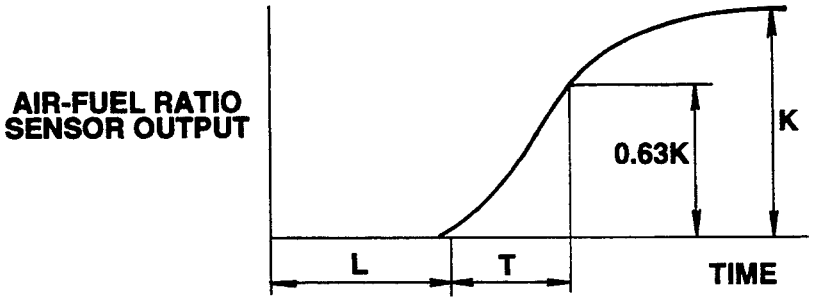
FIG. 6 is a time chart showing variations of an output value of an air-fuel ratio sensor when the air-fuel ratio is changed stepwise.

FIG. 6 shows variations of the output value of the air-fuel ratio sensor 19 when the air-fuel ratio is changed stepwise.

Referring to FIG. 6, assuming a time from a point that the air-fuel ratio is changed to a point that output of the air-fuel ratio sensor 19 is changed, which is called dead time, is L, and a time constant, i.e., time until the output value of the air-fuel ratio sensor 19 reaches 63% of a final variation K thereof, is T, the theoretical formulae of proportional-plus-integral (PI) control are as follows:

$$P=a\cdot(T/K\cdot L)\cdot x \quad (1)$$

$$I=b\cdot(T/K\cdot L^2)\cdot\Sigma x \quad (2)$$

It is confirmed that in the formulae (1) and (2), K is proportional to a level of given disturbance which is a variation of the air-fuel ratio here, and that the dead time L is dominated by a shift time of gas from the fuel injection valve 15 to the air-fuel ratio sensor 19 principally, and also by a residence time of gas in cylinders and a shift time of gas from exhaust valves to the air-fuel ratio sensor 19, i.e., exhaust flow velocity, and it has a substantially proportional relation with the intake air flow Q. Therefore, the dead time L can approximately be given by an inverse number of the intake air flow Q. Additionally, K is an absolute value of an error. Based on a ratio of x to K and that of Σx to K, a relative error is determined as follows:

$$x/K=y,\ \Sigma x/K=\Sigma y$$

Since the time constant T is dominated by the time constant of the air-fuel ratio sensor 19, but substantially constant over a certain temperature due to a characteristic of the air-fuel ratio sensor 19, the time constant T is considered as a fixed value.

Considering the above, the formulae (1) and (2) can be rewritten as follows:

$$P=A\cdot Q\cdot y\cdot(y=x/K,\ \text{and } A \text{ is a constant}) \quad (3)$$

$$I=B\cdot Q^2\cdot\Sigma y\ (\Sigma y=\Sigma x/K,\ \text{and } B \text{ is a constant}) \quad (4)$$

The theoretical formulae (3) and (4) correspond to the steps S16 and S17, respectively.

It is to be noted that weighted average processing and smoothing processing of QLMD as shown in FIG. 4 is carried out for minimizing an error by using a smoothed value since a value of the intake air flow Q detected by the airflow meter 13 is excessive to enlarge the error upon, for example, acceleration as described above.

Having described the present invention in connection with the preferred embodiment, it is to be understood that the present invention is not limited thereto, and various changes and modifications are possible without departing from the spirit of the present invention.

What is claimed is:

1. A system for controlling an air-fuel ratio of air-fuel mixture to be supplied to an internal combustion engine, the system comprising:

an air-fuel ratio sensor means for providing an output value variable in response to a concentration ratio of a constituent in exhaust, said concentration ratio being variable according to the air-fuel ratio;

an air-fuel ratio feedback control means for comparing said output value of said air-fuel ratio sensor means with a reference value corresponding to a target air-fuel ratio and controlling the air-fuel ratio to be close to said target air-fuel ratio by using a feedback correction factor;

a proportional part setting means for setting a proportional part for determining said feedback correction factor, said proportional part being corrected by a value proportional to an intake air flow corresponding value; and an integral part setting means for setting an integral part for determining said feedback correction factor, said integral part being corrected by a value proportional to a square of said intake air flow corresponding value.

2. A system as claimed in claim 1, wherein said intake air flow corresponding value is a value obtained by smoothing a detected value of intake air flow.

3. A method of controlling an air-fuel ratio of air-fuel mixture to be supplied to an internal combustion engine, the method comprising the steps of:

providing an output value variable in response to a concentration ratio of a constituent in exhaust, said concentration ratio being variable according to the air-fuel ratio;

comparing said output value of said air-fuel ratio sensor means with a reference value corresponding to a target air-fuel ratio and controlling the air-fuel ratio to be close to said target air-fuel ratio by using a feedback correction factor;

setting a proportional part for determining said feedback correction factor, said proportional part being corrected by a value proportional to an intake air flow corresponding value; and setting an integral part for determining said feedback correction factor, said integral part being corrected by a value proportional to a square of said intake air flow corresponding value.

4. A method as claimed in claim 3, wherein said intake air flow corresponding value is a value obtained by smoothing a detected value of intake air flow.

* * * * *